US005766760A

United States Patent [19]

Tsai et al.

[11] Patent Number: 5,766,760

[45] Date of Patent: Jun. 16, 1998

[54] MICROPOROUS FIBERS WITH IMPROVED PROPERTIES

[75] Inventors: Fu-Jya Tsai; Vasily Aramovich Topolkaraev, both of Appleton, Wis.

[73] Assignee: Kimberly-Clark Worldwide, Inc., Neenah, Wis.

[21] Appl. No.: 697,993

[22] Filed: Sep. 4, 1996

[51] Int. Cl.[6] ..... D02G 3/00

[52] U.S. Cl. ..... 428/376; 428/372; 428/397; 428/400

[58] Field of Search ..... 428/376, 397, 428/400, 372

[56] References Cited

U.S. PATENT DOCUMENTS

| | | | |
|---|---|---|---|
| 3,132,194 | 5/1964 | Edmonds, Jr. et al. | 264/37 |
| 3,215,486 | 11/1965 | Hada et al. | 8/74 |
| 3,375,208 | 3/1968 | Duddy | 260/2.1 |
| 3,378,507 | 4/1968 | Sargent et al. | 260/2.5 |
| 3,407,151 | 10/1968 | Overcashier et al. | 260/2.5 |
| 3,536,796 | 10/1970 | Rock | 264/49 |
| 3,677,881 | 7/1972 | Riordon | 161/178 |
| 3,839,516 | 10/1974 | Williams et al. | 264/41 |
| 3,957,936 | 5/1976 | Lauchenauer | 264/53 |
| 4,001,367 | 1/1977 | Guthrie et al. | 264/154 |
| 4,013,617 | 3/1977 | Gordon et al. | 260/42.55 |
| 4,020,230 | 4/1977 | Mahoney et al. | 428/398 |
| 4,055,696 | 10/1977 | Kamada et al. | 428/398 |
| 4,055,702 | 10/1977 | Guthrie et al. | 428/398 |
| 4,076,656 | 2/1978 | White et al. | 260/2.5 M |
| 4,257,997 | 3/1981 | Soehngen et al. | 264/145 |
| 4,442,206 | 4/1984 | Michaels et al. | 435/68 |
| 4,550,123 | 10/1985 | Lopatin et al. | 521/64 |
| 4,992,332 | 2/1991 | Kamei et al. | 428/398 |
| 5,043,216 | 8/1991 | Misoo et al. | 428/397 |
| 5,093,197 | 3/1992 | Howard et al. | 428/372 |
| 5,230,843 | 7/1993 | Howard et al. | 264/41 |
| 5,230,949 | 7/1993 | Howard et al. | 428/224 |
| 5,384,082 | 1/1995 | Frankfort et al. | 264/103 |
| 5,439,626 | 8/1995 | Bennett et al. | 264/103 |

FOREIGN PATENT DOCUMENTS

| | | |
|---|---|---|
| 0 348 887 A3 | 3/1990 | European Pat. Off. . |
| WO 92/06577 | 4/1992 | WIPO . |

OTHER PUBLICATIONS

Nago, Satoshi and Yukio Mizutani, "Microporous Polypropylene Sheets Containing Polymethylsilsesquioxane Filler", *Journal of Applied Polymer Science*, vol. 50, 1993, pp. 1815–1822.

Germani, Mark S., "Application of Automated Electron Microscopy to Individual Particle Analysis", *American Laboratory*, Apr. 1993, pp. 17–24.

Vander Wood, T. B., "Introduction to Automated Particle Analysis," *52nd Annual Meeting of the Microscopy Society of America*, San Francisco Press, Inc., San Francisco, Calif., 1994, pp. 398–399.

Nago, Satoshi and Yukio Mizutani, "Microporous Polypropylene Hollow Fibers Containg Poly (Methylsilsesquioxane) Fillers," *Journal of Applied Polymer Science*, vol. 53, 1994, pp. 1579–1587.

Nago, Satoshi and Yukio Mizutani, "Microporous Polypropylene Hollow Fibers With Double Layers," *Journal of Applied Polymers Science*, vol. 56, 1995, pp. 253–261.

*Primary Examiner*—Newton Edwards
*Attorney, Agent, or Firm*—Paul Yee

[57] ABSTRACT

A porous fiber includes a distinctive configuration of voids therein to achieve advantageous levels of wettability, liquid penetration and mechanical properties. The fiber has a denier of not more than about 50, and a percent elongation at break of not less than about 30%. The fiber can also have a tensile strength at break of not less than about 200 MPa.

17 Claims, 10 Drawing Sheets

MICROPOROUS FIBERS WITH IMPROVED PROPERTIES

FIELD OF THE INVENTION

The present invention relates to fibers. More particularly, the invention relates to synthetic, porous fibers which are wettable and which exhibit improved mechanical properties.

BACKGROUND OF THE INVENTION

Porous fibers have included structures made by employing conventional phase separation methods. Such methods generally involve mixing a polymer resin with a diluent or a plasticizer, quenching the polymer solution in a liquid medium to induce phase separation, and washing away the diluent to leave behind an interconnected porous structure. Other porous fibers have been produced by techniques which employ a blowing agent or a swelling agent to create a microporous structure. Still other porous materials have been produced by employing an environmental crazing technique.

Conventional porous fibers, such as those described above, have not been able to provide desired combinations of mechanical properties and water accessibility. In addition, the techniques have not adequately produced porous fibers having desired combinations of small diameter, low denier, high wettability, high permeability to liquid, and high tensile strength. As a result, there has been a continued need for fibers having improved porous structures.

BRIEF DESCRIPTION OF THE INVENTION

Generally stated, the present invention provides a distinctive porous fiber which includes voids therein to achieve desired levels of wettability and liquid penetration while still having good mechanical properties. The fiber can have a denier of not more than about 50, and can have a percent elongation at break of not less than about 30%. The fiber can also have a tensile strength at break of not less than about 200 Mpa.

In its various aspects, the porous fiber of the invention can effectively and efficiently produce fibers having desired combinations of small size, high wettability, high water-accessibility, high tensile strength and high elongation. As a result, the fiber can have an improved ability to be further processed to form nonwoven fabrics and other articles of manufacture.

BRIEF DESCRIPTION OF THE DRAWINGS

The present invention will be more fully understood and further advantages will become apparent when reference is made to the followed detailed description of the invention and the drawings, in which.

DETAILED DESCRIPTION OF THE INVENTION

Figure 1:
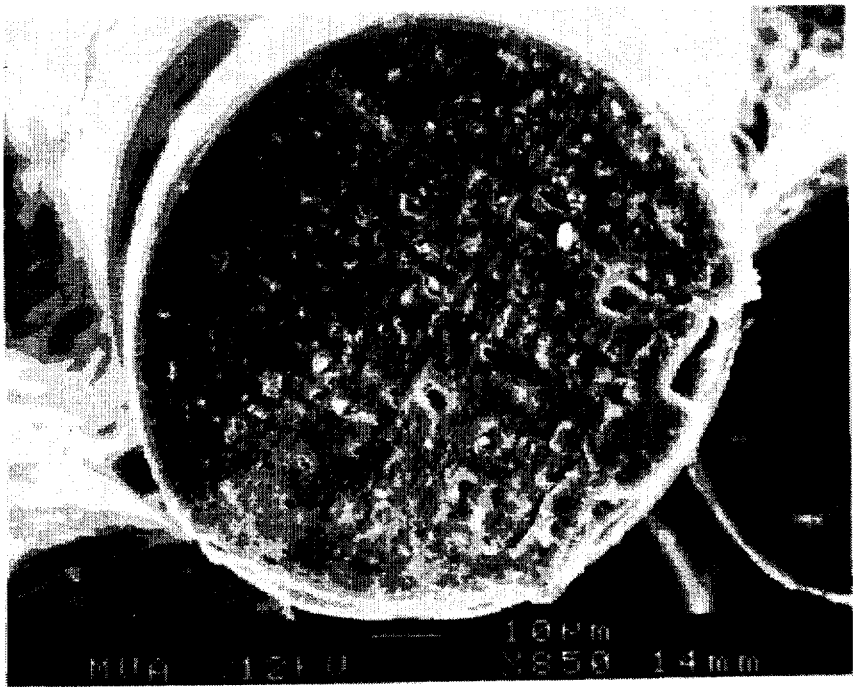
FIG. 1 is a scanning electron photomicrograph, taken at a magnification of 850×, showing a representative cross-sectional view of the porous fiber of the present invention.
Figure 2:
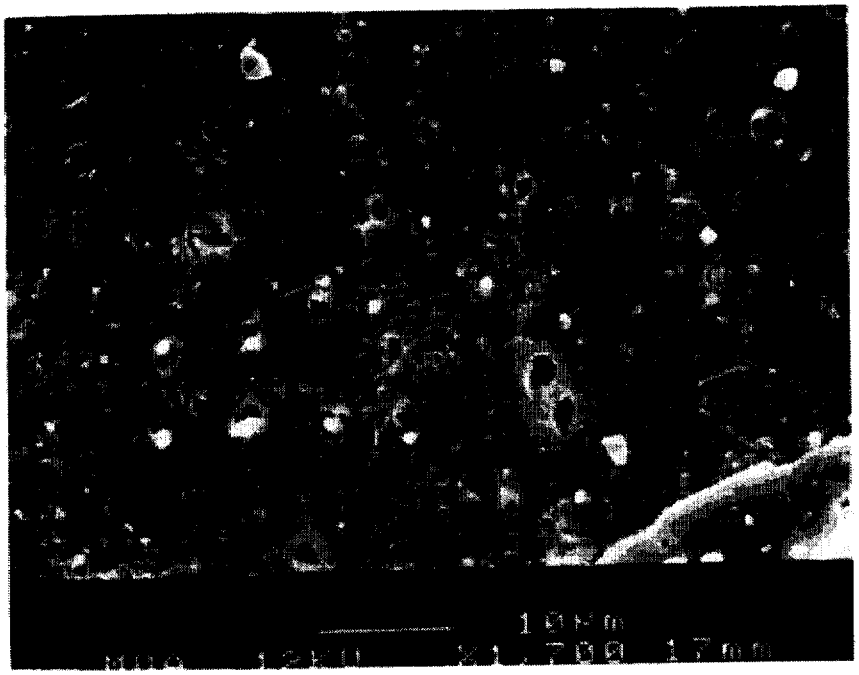
FIG. 2 is a scanning electron photomicrograph, taken at a magnification of 1,700×, showing an enlarged view of a portion of the cross-section shown in FIG. 1.

With reference to FIGS. 1, 2, 7, 8, 9, 9A and 12, a porous fiber 20 includes a length-wise dimension 44 and a generally cross-wise dimension 38. The porous fiber has a distinctive configuration of voids or pores 22 therein to achieve desired levels of wettability, liquid penetration and other liquid accessibility. The fiber, can have a denier (d) per fiber of not more than about 50, and desirably has a percent elongation at break of not less than about 30%. The fiber can also have a tensile strength at break of not less than about 200 MPa. In particular aspects of the invention, the porous fiber 54 can also include other properties, and can include voids or pores having distinctive shapes, sizes, distributions and configurations.

In its various aspects, the microporous fiber of the invention can provide for improved wicking can more quickly bring water or other liquid into the interior of a fibrous article, and can accelerate the dissolution kinetics for fibrous articles which are intended to be flushable. In addition, the microporous fiber can help provide for improved absorbency, improved distribution of liquid, improved the breathability in articles, such as surgical gowns and diapers, improved tactile and aesthetic properties, and/or enhanced biodegradability. The fibers can be formed directly into nonwoven webs with conventional forming processes, such as the well known spunbond process. Alternatively, the fiber may be cut into staple fibers, and may be blended with other fibers for subsequent formation into nonwoven, fibrous webs employing conventional air-laying techniques. The nonwoven webs may be particularly useful for producing flushable personal care products, such as diapers, tampons, feminine pads, pantiliners, tampon strings and the like.

In the various configurations of the present invention, the porous fiber 54 can be a synthetic fiber produced from a source material which includes a thermoplastic, orientable material, such as thermoplastic and orientable polymers, copolymers, blends, mixtures, compounds and other combinations thereof. Desirably, the thermoplastic materials do not include highly reactive groups.

In particular arrangements of the invention, the source material can be a polyolefinic material. For example, the source material may include homopolymers of polyethylene or polypropylene, or may include copolymers of ethylene and polypropylene. In other arrangements, the source material may include another polymer material, such as a polyether, a copolyether, a polyamid, a copolyamid, a polyester or a copolyester, as well as copolymers, blends, mixtures and other combinations thereof.

The thermoplastic material is melt processible, and in particular aspects of the invention, the material can have a melt flow rate (MFR) value of not less than about 1 g/10 minutes (based on ASTM D1238-L). Alternatively, the MFR value can be not less than about 10g/10 minutes, and optionally, can be not less than about 20 g/10 minutes. In other aspects of the invention, the MFR value can be not more than 200 g/10 minutes. Alternatively, the MFR value can be not more than about 100g/10 minutes, and optionally, can be not more than about 40 g/10 minutes to provide desired levels of processibility.

Such melt processible, thermoplastic material can, for example, be provided by a homopolymer polypropylene. Commercially available polyolefins, such as Himont PF 301, PF 304, and PF 305, Exxon PP 3445, Shell Polymer E5D47, are also representative of suitable materials. Still other suitable materials can include, for example, random copolymers, such as a random copolymer containing propylene and ethylene (e.g. Exxon 9355 containing 3.5% ethylene), and homopolymers, such as homopolymer polyethylene, which have MFR values similar to those mentioned herein. The polymer resins may contain small amounts (e.g. about 0.05 to 5 parts of additive to 100 parts of resin) of processing additives, such as calcium sterate or other acid scavengers. Other additives can include, for example, silicon glycol copolymers, organosilicone compounds, olefinic elastomers, and low molecular weight parafins or other lubricating additives. Various pigment additives may also be incorporated. For example, pigment concentrates such as a titanium dioxide pigment concentrate with low molecular weight polyethylene plasticizer can be employed as a processing additive. The various additives can have a plasticizing effect, can improve the strength and softness of the fiber, and can help facilitate one or more of the extrusion, fiber spinning, and stretching processes.

The source material for the fiber 54 can also include a further supplemental material, and the supplemental material may include a filler material, and/or a surfactant or other surface-active material. The filler material can be a particulate material which can help provide porosity-initiating, debonding sites to enhance the desired formation of pores during the various stretching operations applied to the fiber. The filler material can help provide a desired surface-modified fiber, and can help enhance a desired "sliding effect" generated during subsequent stretching operations. In addition, the filler material help preserve the pores that are generated during the various stretching operations.

Where the supplemental material includes a surface-active material, such as a surfactant or other material having a low surface energy (e.g. silicone oil), the surface-active material can help reduce the surface energy of the fiber as well as provide lubrication among the polymer segments which form the fiber. The reduced surface energy and lubrication can help create the "sliding effect" during the subsequent stretching operations.

The supplemental filler material can be organic or inorganic, and the filler material is desirably in the form of individual, discrete particles. The fillers may be subjected to a surface treatment with various coatings and surfactants to impart an affinity to the polymer resin in the source material, to reduce agglomeration, to improve filler dispersion, and to provide a controlled interaction with fluids, such as body fluids, blood or water. Examples of an inorganic filler can include metal oxides, as well as hydroxides, carbonates and sulfates of metals. Other suitable inorganic filler materials can include, for example, calcium carbonate, various kinds of clay, silica, alumina, barium sulfate, sodium carbonate, talc, magnesium carbonate, magnesium sulfate, barium carbonate, kaolin, mica, carbon, calcium oxide, magnesium oxide, aluminum hydroxide, titanium dioxide, powdered metals, glass microspheres, or vugular void-containing particles. Still other inorganic fillers can include those with particles having higher aspect ratios, such as talc, mica, and wollastonite, but such fillers may be less effective. Representative organic fillers can include, for example, pulp powders, wood powders, cellulose derivatives, chitin, chitosan powder, powders of highly crystalline, high melting polymers, beads of highly crosslinked polymers, powders of organosilicones, and the like; as well as combinations and derivatives thereof.

In particular aspects of the invention, the fillers can have an average particle size which is not more than about 10 microns (μm). Alternatively, the average particle size can be not more than about 5 μm, and optionally, can be not more than about 1 μm to provide improved processibility. In other aspects of the invention, the top cut particle size is not more than about 25 μm. Alternatively, and the top cut particle size can be not more than about 10 μm, and optionally can be not more than about 4 μm to provide improved processability during the formation of fibers having the desired size and porous structure. The fillers may also be surface-modified by the incorporation of surfactants, and /or other materials, such as stearic or behenic acid, which can be employed to improve the processibility of the source material.

Examples of suitable filler materials can include one or more of the following (1) Dupont R-101 $TiO_2$, which is available from E.I. DuPont de Nemours, and can be supplied in a concentrate form by Standrich Color Corporation, a business having offices located in Social Circle, Ga. 30279. This material can provide good processibility.

(2) Pigment Blue 15:1(10 % copper), which is distributed by Standridge Color Corporation. Fibers produced with this material may break more often.

(3) OMYACARB® UF $CaCO_3$, which is available from OMYA, Inc., a business having offices located in Proctor, Vt. 05765. This material can have a top cut particle size of about 4 μm and a average particle size of about 0.7μm, and can provide good processibility. This filler can be coated with a surfactant, such as Dow Corning 193 surfactant, before the compounding or other combining with the source material 56. The filler can also be coated with other appropriate surfactants, such as those mentioned elsewhere in the present description.

(4) OMYACARB ® UFT $CaCO_3$ coated with stearic acid, which is available from OMYA, Inc. This material can have a top cut particle size of about 4 μm and a mean particle size of about 0.7μm, and can provide good processibility.

(5) SUPERCOAT™ $CaCO_3$which is available from ECC International, a business having offices located in Atlanta, Ga. 30342, 5775 Peachtree-Dunwoody Road. This material can have a top cut particle size of about 8 μm and a mean particle size of about 1 μm. Fibers produced with this material may break more often.

(6) Powdered polydimethyl silsesquioxane (#22 or #23 Dow Corning Additive), which is available from Dow Corning, a business having offices located in Midland, Mich. 48628-0997. This material can provide good processibility, while some agglomerations may be observed.

The supplemental material can optionally include a surface-active material, such as a surfactant or other material having a low surface energy (e.g. silicone oil). In particular aspects of the invention, the surfactant, or other surface-active material, can have a Hydrophile-Lipophile Balance (HLB) number which is not more than about 18. Alternatively, the HLB number is not more than about 16, and optionally is not more than about 15. In other aspects of the invention, the HLB number is not less than about 6. Alternatively, the HLB number is not less than about 7, and optionally the HLB number is not less than about 12. When the HLB number is too low, there can be insufficient wettability. When the HLB number is too high, the surfactant may have insufficient adhesion to the polymer matrix of the source material, and may be too easily washed away during use. The HLB numbers of commercially available surfactants can, for example, be found in McCUTCHEON's Vol 2: Functional Materials, 1995.

A suitable surfactant can include silicon glycol copolymers, carboxilated alcohol ethoxylates, various ethoxylated alcohols, ethoxylated alkyl phenols, ethoxylated fatty esters and the like, as well as combinations thereof. Other suitable surfactants can, for example, include one or more of the following:

(1) surfactants composed of ethoxylated alkyl phenols, such as IGEPAL RC-620, RC-630, CA-620, 630, 720, CO-530, 610, 630, 660, 710 and 730, which are available from Rhone-Poulenc, a business having offices located in Cranbury, N.J.

(2) surfactants composed of silicone glycol copolymers, such as Dow Corning D190, D193, FF400, and D1315, which are available from Dow Corning, a business having offices located in Midland, Mich.

(3) surfactants composed of ethoxylated mono-and diglycerides, such as Mazel 80 MGK, Masil SF 19, and Mazel 165C, which are available from PPG Industries, a business having offices located in Gumee, Ill. 60031.

(4) surfactants composed of ethoxylated alcohols, such as Genapol 26-L-98N, Genapol 26-L-60N, and Genapol 26-L-5, which are available from Hoechst Celanese Corp., a business having offices located in Charlotte, N.C. 28217.

(5) surfactants composed of carboxilated alcohol ethoxylates, such as Marlowet 4700 and Marlowet 4703, which are available from Huls America Inc., a business having offices located in Piscataway, N.J. 08854.

(6) ethoxylated fatty esters, such as Pationic 138C, Pationic 122A, and Pationic SSL, which are available from R.I.T.A. Corp., a business having offices located in Woodstock, Ill. 60098.

The source material for the porous fiber 54 can include not less than about 0.35 wt % of the supplemental material, where the weight percentage is determined with respect to the total weight of the combined source material. In particular aspects of the invention, the amount of supplemental material is not less than about 0.5 wt %, and may desirably be at least about 1 wt %. Alternatively, the amount of supplemental material is not less than about 5 wt %, and optionally is not less than about 10 wt %. In other aspects of the invention, the amount of supplemental material can be up to about 50 wt % or more. The amount of supplemental material is desirably not more than about 30 wt %. Alternatively, the amount of supplemental material can be not more than about 20 wt % and optionally can be not more than about 15 wt % to provide desired processibility characteristics.

In particular aspects of the invention, the source material can include not less than about 0.35 wt % of the filler material. In particular aspects of the invention, the amount of filler material is not less than about 0.5 wt %. Alternatively, the amount of filler material is not less than about 1 wt %, and optionally is not less than about 5 wt %. In other aspects of the invention, the amount of filler material can up to about 50 wt % or more. The amount of filler material may desirably be not more than about 30 wt %. Alternatively, the amount of filler material can be not more than about 20 wt % and optionally can be not more than about 10 wt %.

In further aspects of the invention where the supplemental material includes a surface-active material, the amount of surface-active material, such as surfactant, may be at least about 0.1 wt %. Alternatively, the amount of surface-active material is at least about 1 wt %, and optionally, is at least about 3 wt %. In other aspects of the invention, the amount of surface-active material is not more than about 20 wt %. Alternatively, the amount of surface-active material is not more than about 15 wt %, and optionally, is not more than about 10 wt %.

A suitable technique for forming the porous fiber 54 is described in U.S. patent application Ser. No. 08/697,966 entitled METHOD AND APPARATUS FOR MAKING MICROPOROUS FIBERS WITH IMPROVED PROPERTIES, filed Sep. 4, 1996 by F. J. Tsai et al. (attorney docket No. 12,242), the entire disclosure of which is hereby incorporated by reference in a manner that is consistent (not in contradiction) herewith.

Figure 5:
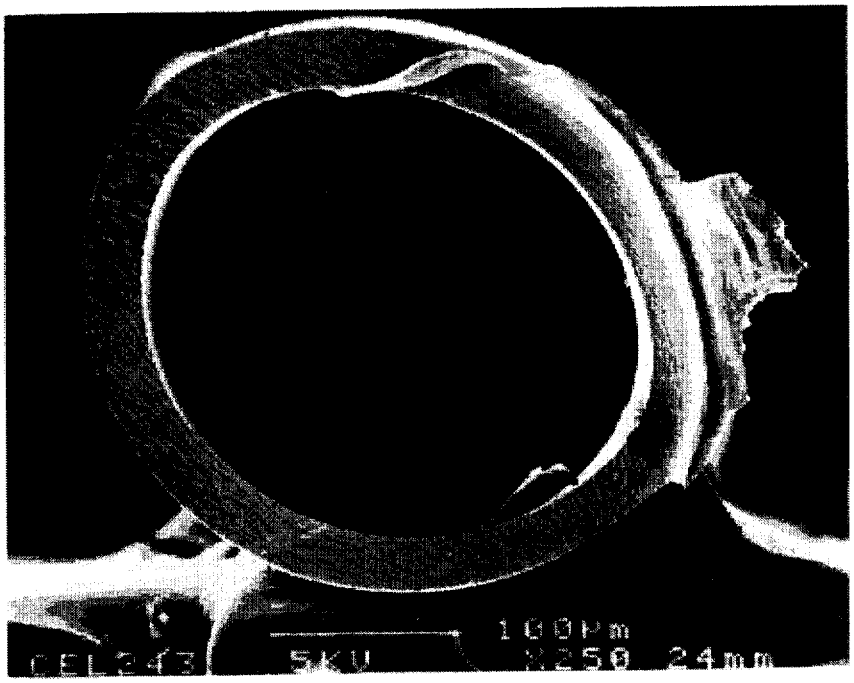
FIG. 5 is a scanning electron photomicrograph, taken at a magnification of 250×, showing a representative cross-section view of another prior art fiber which includes a lumen, and was produced by an incremental stretching process.

Conventional porous fibers have often included lumens therein. The lumen is typically a bore extending through a tube of fiber material, as representatively shown in FIGS. 3 and 5. Accordingly, the lumen typically provides a hollow fiber in which the ratio of the outer diameter of the tube to the diameter of the bore can be within the range of 50:1 to 50:48. Fibers with lumens usually are more tedious to manufacture, and can be susceptible to undesired collapse when the fibers are processed at high speeds. In addition, such fibers have exhibited inadequate mechanical strength properties, which have made it difficult to further process the fibers to form nonwoven fabrics.

The porous fiber 54 of the present invention, however, is substantially free of lumens. As a result, the fiber can exhibit an increase in melt strength during the fiber formation, and the greater melt strength can improve the in-line spinnability and stretchability of the fiber. For example, simpler die designs can be employed to form the nascent fiber. The porous fiber can also exhibit increased mechanical strength to provide improved dimensional stability, and can exhibit other improved mechanical properties to facilitate the subsequent processing of the fiber. For example, the improved mechanical properties can improve the ability to further process the fibers to produce nonwoven fabric webs. In its various aspects, the porous fiber 54 can also exhibit improved combinations of small diameter, low denier, tensile strength, elongation, and toughness (where toughness is the ability to absorb energy, as described in the *Dictionary of Fiber & Textile Technology*, Hoechst Celanese, 1990).

The various configurations of the porous fiber 54 can have relatively low diameter and relatively low denier. In particular aspects, the porous fiber can have a fiber denier of not more than about 50. Alternatively, the porous fiber denier can be not more than about 20, and optionally can be not more than about 10. In other aspects, the porous fiber can have a denier of about 0.5, or less, and optionally can have a denier of about 0.1, or less to provide improved performance.

In other aspects, the tensile strength at break of the porous fiber 54 can be not less than about 200 mega-Pascal (MPa). Alternatively, the tensile strength can be not less than about 250 MPa, and optionally can be not less than about 300 MPa. In other aspects, the method and apparatus of the invention can provide for a fiber tensile strength which is not more than about 1000 mega-Pascal (MPa). Alternatively, the fiber tensile strength can be not more than about 750 MPa, and optionally can be not more than about 450 MPa to provide improved performance and processibility during subsequent manufacturing operations.

In further aspects, the porous fiber 54 can exhibit a percent elongation to break of not less than about 30%, as determined by the formula: $(L_f-L_i)/L_i$; where $L_f$ is the final length of the fiber at break, and $L_i$ is the initial length of the fiber prior to elongation. Alternatively, the elongation to break can be not less than about 50%, and optionally can be not less than about 90%. In further aspects, the method and apparatus of the invention provides for a porous fiber 54 which can exhibit a percent elongation to break of up to about 500%, or more. Alternatively, the elongation to break can be not more than about 200%, and optionally can be not more than about 160% to provide desired performance attributes and processing capabilities.

In still other aspects of the invention, the porous fiber 54 can have a toughness index of not less than about 0.1 gram-centimeter per denier-centimeter (g-cm/denier-cm). Alternatively, the fiber toughness can be not less than about 1.5 g-cm/denier-cm, and optionally can be not less than about 2 g-cm/denier-cm. Additional aspects of the invention can provide for a porous fiber 54 which has a toughness index of not more than about 20 g-cm/denier-cm. Alternatively, the fiber toughness index can be not more than about 10 g-cm/denier-cm, and optionally can be not more than about 5 g-cm/denier-cm to provide improved performance. The toughness index represents the ability of the fiber to absorb energy, and is determined by multiplying the fiber tenacity times the fiber elongation-at-break, and then dividing by 2. For example, a typical calculation would be (grams load-at-break× elongation-at-break)/(denier ×2), and may have the units of (grams-cm)/(denier-cm)

Suitable testing techniques for obtaining the data for determining the various mechanical properties of the porous fiber are further described in the *Test Procedures* section, set forth hereinbelow.

The porous fiber 54 can advantageously provide improved water accessibility. In particular aspects of the invention, the water uptake rate of the porous fiber 54 can be not less than 0.1 mg/sec. Alternatively, the water uptake rate can be not less than about 0.15 mg/sec, and optionally can be not less than about 0.2 mg/sec. In other aspects, the water uptake rate can be not more than about 15 mg/sec. Alternatively, the water uptake rate can be not more than about 5 mg/sec, and optionally can be not more than about 1.5 mg/sec to provide improved benefits. In comparison, a nonporous fiber will have a water-uptake rate of less than 0.1 mg/sec, as illustrated by Examples 8, 9 and 10 set forth hereinbelow.

In addition, the water-uptake amount of the porous fiber 54 can be not less than 0.1 mg in 60 sec. Alternatively, the water uptake amount can be not less than about 0.2 mg in 60 sec, and optionally can be not less than about 0.3 mg in 60 sec. In other aspects, the water uptake amount may be not more than about 25 mg in 60 sec. Alternatively, the water uptake amount can be not more than about 5 mg in 60 sec, and optionally can be not more than about 2.5 mg in 60 sec to provide improved benefits. In comparison, a nonporous fiber will have a water-uptake amount of less than 0.1 mg in 60 sec, as illustrated by Examples 8, 9 and 10 set forth below.

Suitable testing techniques for obtaining the data for determining the various water accessibility properties of the porous fiber are further described in the *Test Procedures* section, set forth below.

A plurality of the voids or pores 52 which impart the desired porosity to the fiber 54 can be distributed over the outer surface of the fiber and can also be distributed through the interior of the fiber. In particular aspects, the porous structure of the fiber 54 includes elongate voids of generally ellipsoidal and/or double-conical shape, such as those representatively shown in FIGS. 7, 8, 9 and 9A. Desirably, the elongate voids 52 have their long, major axes 48 aligned substantially along a length-wise, longitudinal dimension 44 of the fiber. In particular aspects of the invention, the elongate voids can have a major axis 48 wherein the length 42 of the major axis is not less than about 0.1 μm. Alternatively, the major axis length is not less than about 0.2 μm, and optionally is not less than about 0.25 μm. In other aspects, the length of the major axis is not more than about 30 μm. Alternatively, the major axis length 42 is not more than about 10 μm, and optionally is not more than about 7 μm to provide improved performance.

To help provide for the desired combination of mechanical strength and water accessibility, particular aspects of the invention have fibers in which the voids of desired pore size dimensions constitute at least about 30% of the total number of pores on either or both of the fiber outer surface or fiber cross-section. Alternatively, the voids of the desired pore size dimensions constitute at least about 50%, and optionally constitute at least about 60% of the total number of pores on either or both of the fiber outer surface or fiber cross-section.

In further aspects of the porous fibers of the invention, the voids having a major axis length within the range of about 0.25–10 μm constitute at least about 30% of the total number of pores on either or both of the fiber outer surface or fiber cross-section. Alternatively, the voids of the 0.25–10 μm pore size dimensions constitute at least about 50%, and optionally constitute at least about 60% of the total number of pores on either or both of the fiber outer surface or fiber cross-section to provide improved mechanical and water accessibility properties.

The elongate pores or voids can also have an aspect ratio value which is determined by the ratio of the length 42 of the pore major axis 48 to the length 40 of a pore minor axis 46 which is aligned perpendicular to the major axis, as observed in the photomicrograph or other imaging or measuring mechanism employed to determine the aspect ratio. In further aspects of the invention, the aspect ratio is not less than about 1.3. Alternatively, the aspect ratio is not less than about 1.5, and optionally is not less than about 2. In other aspects, the aspect ratio is not more than about 50. Alternatively, the aspect ratio is not more than about 20, and optionally is not more than about 15 to provide improved porosity characteristics and fiber performance. The major axis of each elongate pore or void is typically an axis aligned substantially along the longitudinal dimension of the fiber, and can typically be represented by the largest length measurement of each pores.

As illustrated in FIGS. 7, 8, 9 and 9A, the porous structure of the fiber 54 can have pores distributed along the outer surface of the fiber. The surface pores have a distribution with a pore number per unit of outer surface area (average distributional density) of not less than about 0.01/$\mu m^2$0.01 roids per $\mu m^2$. Alternatively, the pore number per unit of outer surface area is not less than about 0.015/$\mu m^2$, and optionally is not less than about 0.05/$\mu m^2$. In further aspects, the pore number per unit of outer surface area is not more than about 10/$\mu m^2$10 roids per $\mu m^2$. Alternatively, the pore number per unit of outer surface area is not more than about 8/$\mu m^2$, and optionally is not more than about 5/$\mu m^2$ to provide improved wettability and liquid penetration.

As illustrated in FIGS. 1, 2, 12 and 13, the porous structure of the invention, with respect to the cross-sectional area of the fiber 54, can exhibit pore voids with an average pore area (per pore) of not less than about 0.001 micron$^2$ ($\mu m^2$). Alternatively, the average pore area (per pore) is not less than about 0.002 $\mu m^2$, and optionally is not less than about 0.03 $\mu m^2$. In other aspects, the average pore area (per pore) is not more than about 20 $\mu m^2$. Alternatively, the average pore area (per pore) is not more than about 10 $\mu m^2$, and optionally is not more than about 3 $\mu m^2$ to provide improved wettability and liquid penetration.

The porous structure of the fiber 54 can also have pores distributed along its cross-sectional area to provide a pore number per unit area (average distributional density) which is not less than about 0.01/$\mu m^2$0.01 roids per $\mu m^2$. Alternatively, the pore number per unit of area is not less than about 0.015/$\mu m^2$, and optionally is not less than about 0.1/$\mu m^2$. In other aspects, the pore number per unit area is not more than about 10/$\mu m^2$10 roids per $\mu m^2$. Alternatively, the pore number per unit area is not more than about 8/$\mu m^2$, and optionally is not more than about 5/$\mu m^2$ to provide improved wettability and liquid penetration.

In further aspects, the porous structure of the fiber 54 has pores distributed along the fiber cross-section wherein a sum of the areas of the individual, cross-sectioned pores provides a total pore area which not less than about 0.1% of the total area encompassed by the cross-sectioned fiber (a percent pore area of not less than about 0.1%). Alternatively, the percent pore area is not less than about 1%, and optionally is not less than about 2%. In other aspects, the percent pore area is not more than about 70%. Alternatively, the percent pore area is not more than about 50%, and optionally is not more than about 20% to provide improved wettability and liquid penetration.

With reference to FIGS. 1, 2, 9, 9A and 12, particular aspects of the porous fiber can include a plurality of voids or pores which are mainly initiated at structural irregularities discontinuities or other physical non-homogenities of the fiber material, and which are stretched and expanded therefrom. Such initiator, structural non-homogenities can be provided by one or more of the following mechanisms: particulate filler/polymer resin interfaces, density and/or modulus fluctuations in a fiber material, submicron size voids and/or air bubbles, any type of inclusions having a modulus and /or density which varies from that of the fiber material, as well as combinations of the mechanisms. More particularly, the fiber can desirably include a plurality of stretched or otherwise extended voids wherein each of the voids can be associated with a particulate initiator 50 provided by a material composed of a multiplicity of individual particles, such as a particulate filler material. The pores or voids can substantially surround the initiators or can be immediately adjacent to the initiators. The pores may also be located in the areas between individual initiators. Additionally, each of the extended voids can have a length which is larger than a length of its associated initiator, as observed when viewing the voids in a length-wise section taken along the fiber length. With respect to a direction along the fiber length, the voids can have a substantially elongated elliptical shape, and/or may have a substantially double-cone configuration with the two cones arranged base-to-base. With respect to a cross-section taken perpendicular to the fiber length, the voids can have a generally spherical shape or a slightly oval or egg shape. In a particular aspect of the microporous fibers of this invention, substantially no specific pattern or regular arrangement of the voids is observed in a surface view or other lengthwise view of the fiber. In another aspect, substantially no specific pattern or regular arrangement of the voids is observed in a representative cross-sectional view of the fiber. Accordingly, the arrangement of the voids in the fiber material can be irregular, and may be substantially random, with some irregular clustering. For example, there may be such clustering in the areas of agglomeration of any incorporated filler material. The observed structure of the porous fiber of the invention can have a broad pore size distribution in a particular cross-section of the fiber due to scattered pore distributions and the nature of the changing, tapering cross-sections of the pores along the length of the fiber. The elongated shapes (e.g. elliptical or double-conical shapes) of the voids and the lack of specific void distribution patterns can clearly differentiate microporous fiber structure of this invention from the porous fibers obtained by a phase separation method or by other stretching methods, such as the incremental stretching method employed for producing CELGARD microporous fibers.

Figure 11:
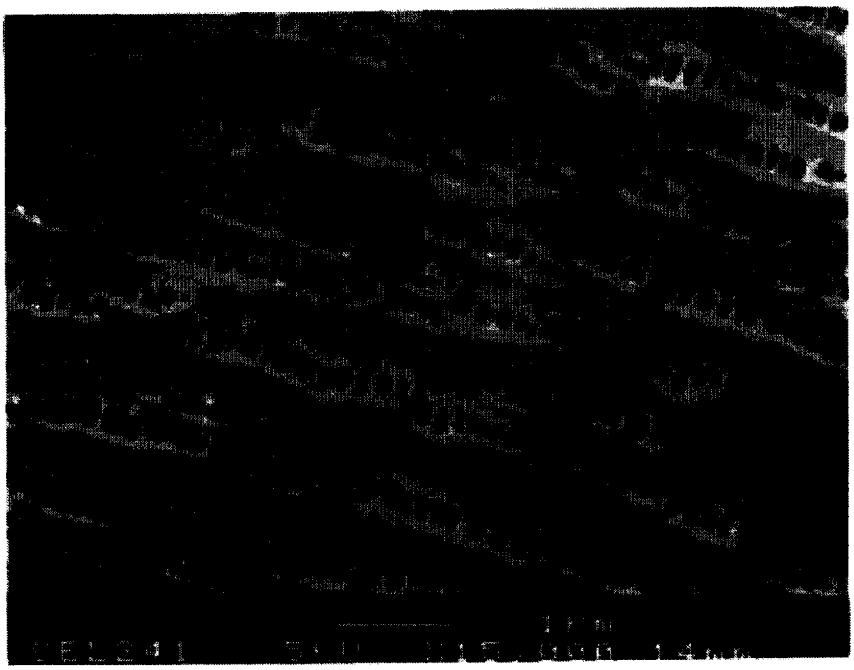
FIG. 11 is a scanning electron photomicrograph, taken at a magnification of 15,000×, providing a representative view of the surface of the fiber shown in FIG. 5.
Figure 12:
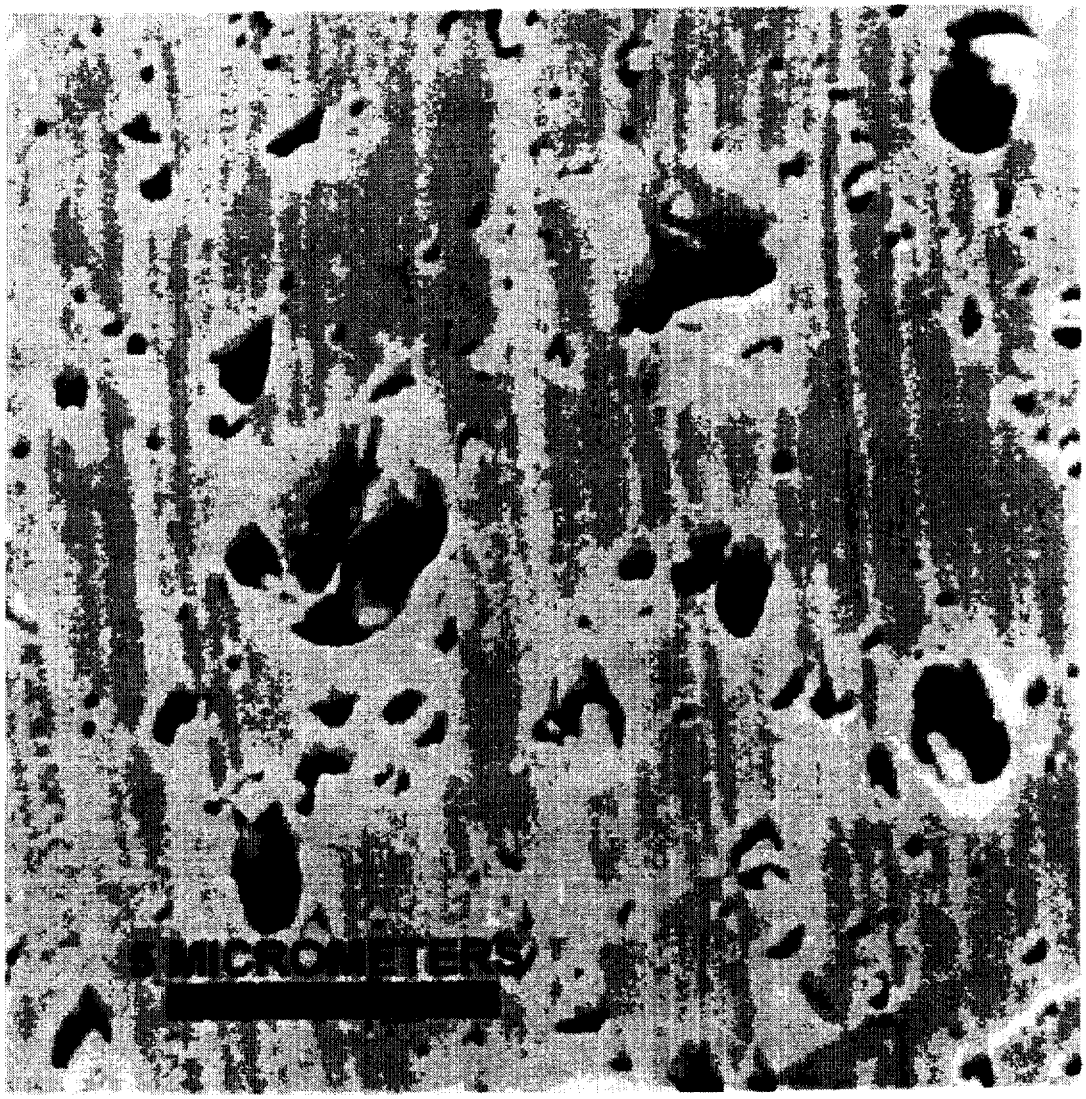
FIG. 12 shows a backscattered electron photomicrograph, taken at a magnification of 5,000×, showing a representative cross-sectional view of a fiber of the invention.
Figure 13:
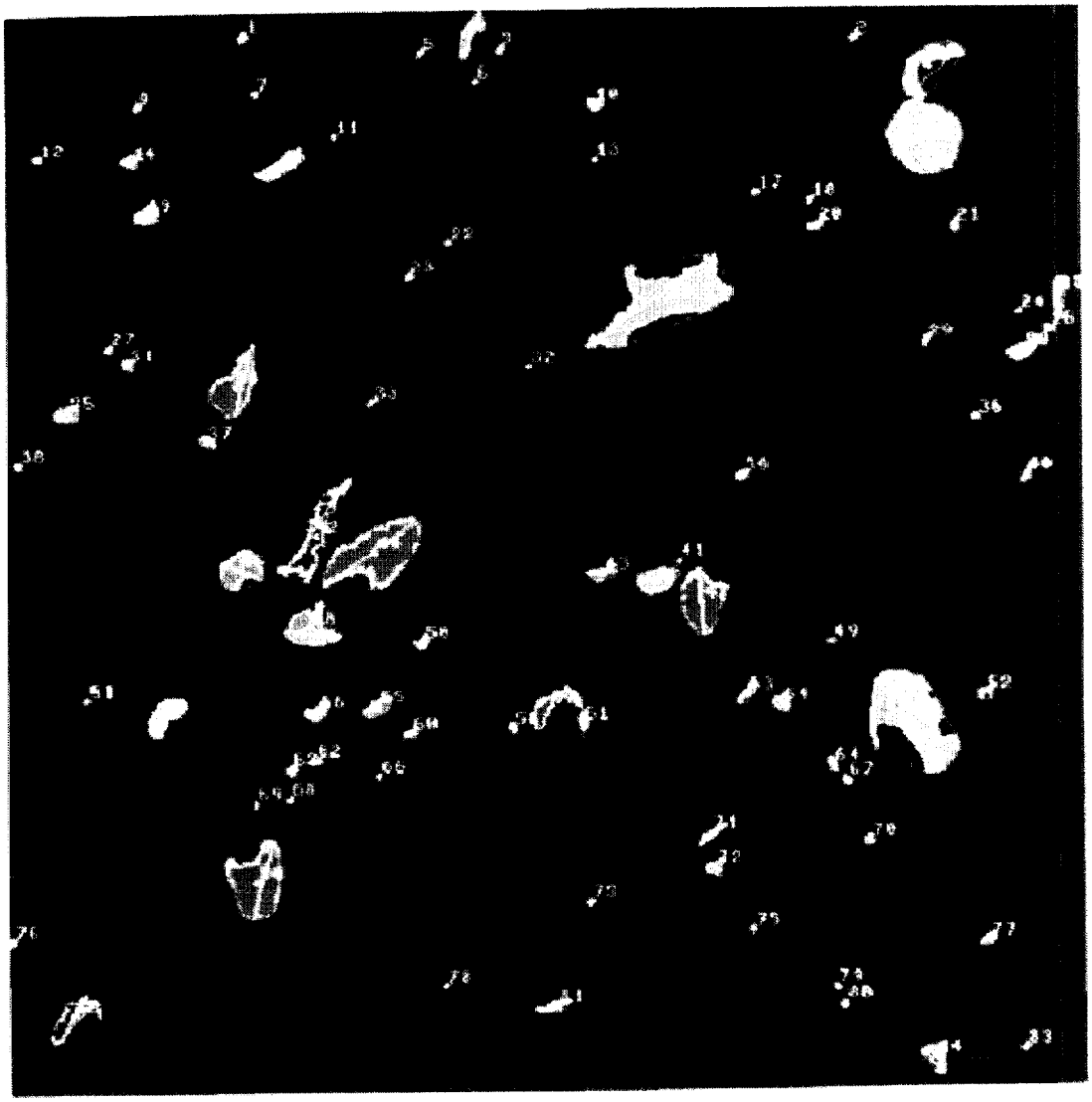
FIG. 13 shows a representative version of FIG. 12 which has been digitized for image analysis.

In a surface view of a CELGARD fiber at a magnification of 15,000×, as representatively shown in FIG. 11, numerous micropores of generally oval or rectangular-like shape are arranged into strips of generally planar microporous zones aligned approximately along the direction perpendicular to the fiber length. These strips of microporous zones are further arranged into arrays in which the strips occur in a nearly periodic, regular fashion.

Figure 3:
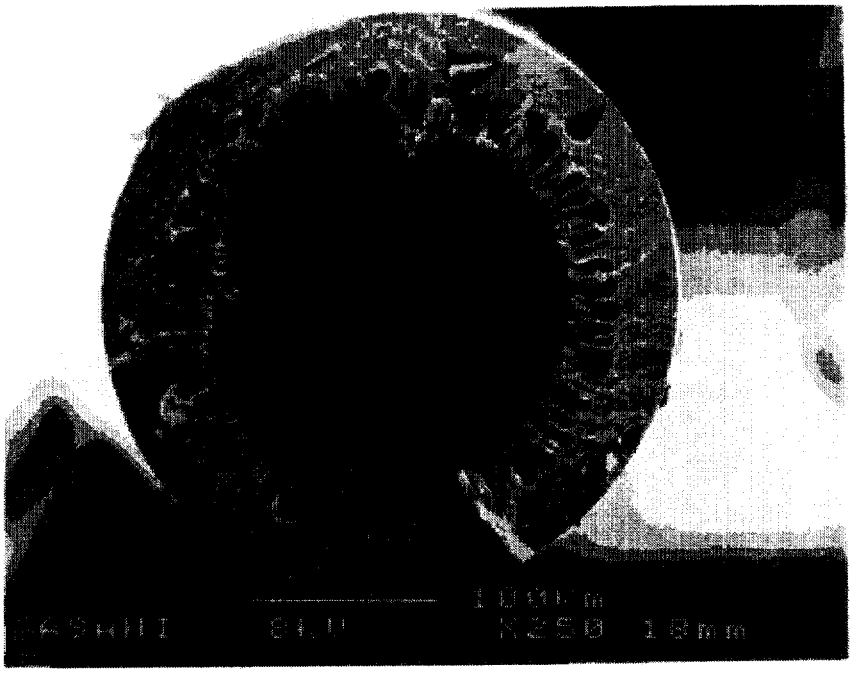
FIG. 3 is a scanning electron photomicrograph, taken at a magnification of 250×, showing a representative cross-sectional view of a prior art fiber which includes a lumen.
Figure 4:
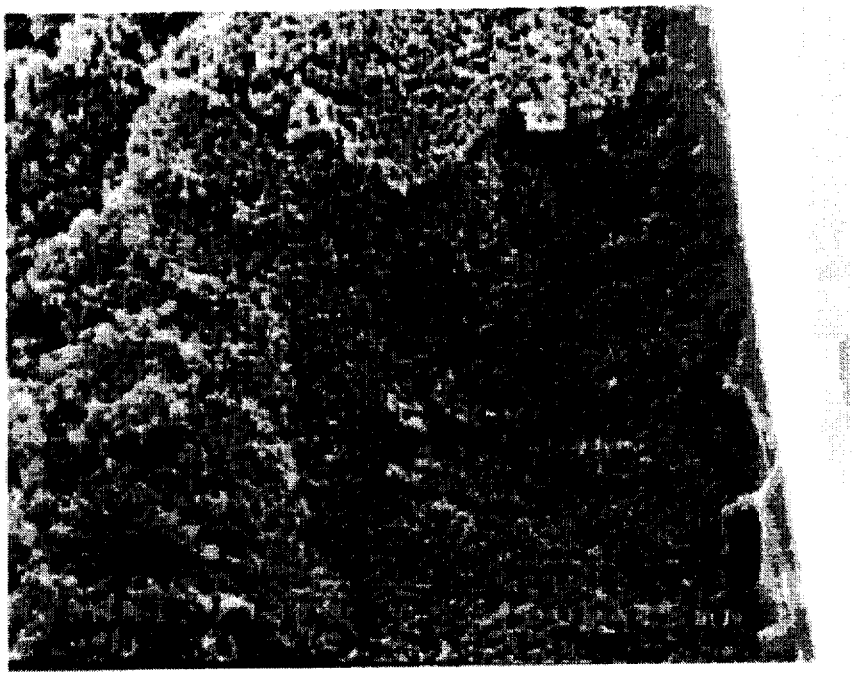
FIG. 4 is a scanning electron photomicrograph, taken at a magnification of 8,000×, showing an enlarged view of the cross-section shown in FIG. 3 at a location adjacent to the outer surface of the fiber.
Figure 10:
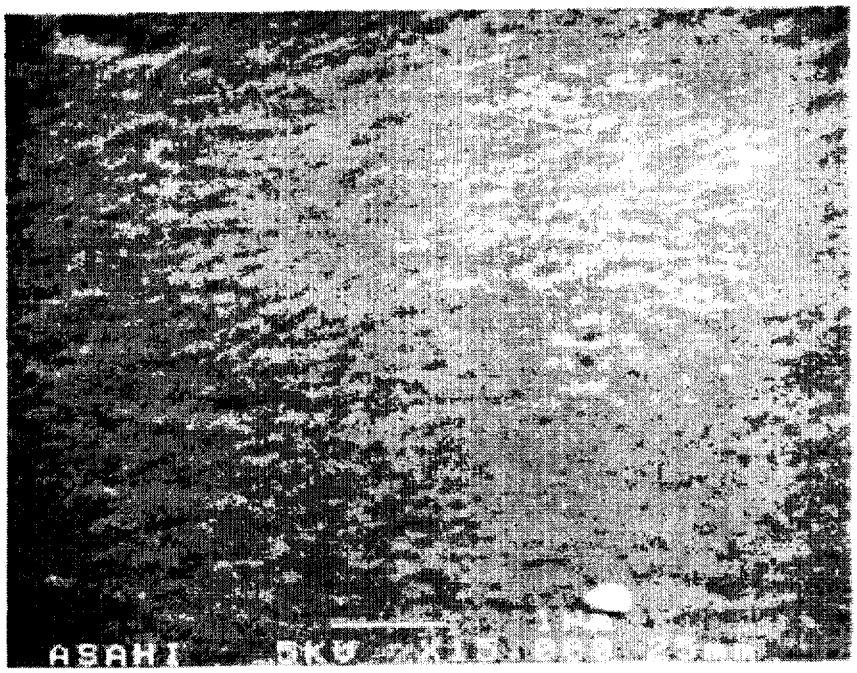
FIG. 10 is a scanning electron photomicrograph, taken at a magnification of 15,000×, providing a representative view of the surface of the fiber shown in FIG. 3.

With reference to FIGS. 3, 4 and 10, a porous fiber obtained by a conventional phase separation method includes a sponge-like system of pores or voids separated by relatively thin walls The system is assembled into a lacy, interconnected structure which defines the pores with membrane-like walls. In the shown configuration, the system forms layers of finger-like macrovoids located adjacent to the hollow fiber lumen. The arrangement of the voids, particularly along the fiber cross-section, provides for a substantially regular array. With reference to FIG. 10, the surface of the fiber appears substantially nonporous under a magnification of 15,000×.

In contrast, particular aspects of the porous fiber of the invention can include pores bounded by tensile-stressed, elongated regions which can, for example, be provided by a plastic deformation in the fiber material. The stressed regions can be observed at least along boundary edges of the extended, surface voids present on the exposed, outermost surface of the fiber. In the porous fiber of the invention, the edge boundaries and edge perimeters of the fiber material are angular, sharply defined, substantially nonfilamented and substantially non-spongiform in the areas surrounding the extended, elongated void. Accordingly, the voids are effectively bounded by fiber material having such boundary edges, and these boundary edges may be observed along any or all of the surface view, cross-sectional view or bulk view of the fiber. The fiber material in the regions observed between the voids generally has the form of a plateau interrupted by the voids.

Suitable techniques for obtaining the data for determining the various pore size properties and pore distributions of the porous fiber are further described in the *Test Procedures* section, set forth below.

Testing Procedures

Mechanical properties

A suitable technique for determining the mechanical properties of the porous fiber 54 can employ a Sintech tensile tester (SINTECH 1/D) and Testworks 3.03 software. The tensile tester is a device available from MTS System Co., a business having offices located in Cary, N.C. 27513. The software is available from MTS System Co., Sintech Division, a business having offices located in Cary, N.C. 27513. Equipment and software having substantially equivalent capabilities may also be employed.

Mechanical properties can be evaluated with the tensile tester using its fiber-testing configuration. The testing is conducted with a 10 pound (44.5N) load cell, and air actuated, rubber coated 3 inch (7.6 cm) grips. The fiber testing is conducted with a 2 inch (5.08 cm) gauge length and a 500.00 mm/min crosshead speed. A single sample fiber is loaded perpendicular to and in the center of the grips, and is held in place when air pressure closes the grips together. The diameter of the fiber is inputted by the user before beginning the tensile testing. For the hollow fiber samples, such as those shown in Examples 11 and 12, the annular cross-sectional area, $\pi$ ((outer radius)$^2$–(inner radius)$^2$), was used for the calculation of the tensile strength. In each experiment, the fiber is stretched until breakage occurs, and the equipment software or other equipment programming creates a stress-versus-strain plot and calculates the desired mechanical properties for the sample. The mechanical properties can include, for example, Young's modulus, stress at break, and % strain or elongation at break.

Water accessibility

A suitable technique for determining the comparative water accessibility properties of the fiber can employ a CAHN DCA 322 microbalance, a device which is available from ATI (Analytical Technology, Inc.), a business having office located in Madison, Wis. The balance is sensitive to force changes as little as 0.1 micrograms and is equipped with two weighing positions (the "A" loop and the "B" loop), and a tare position (the "C" loop). The "A" loop can support a maximum load of 1.5 grams and the "B" loop can support a load of 3.5 grams. Thus, the A loop has better sensitivity while the B loop can support a heavier load. It is understood that the operator will select the loop which provides the greater measurement sensitivity while also remaining capable of measuring the maximum load expected during the testing. The fiber testing for the examples set forth herein was conducted on the "A" loop of the balance. Each fiber sample has a sufficient length (e.g. about 15 mm) which allows the fiber to be operably taped or otherwise secured along and against a hanging wire or similar support to provide a test sample. In the test sample, a 5 mm length of the support wire and its adjacently held fiber sample extends below the tape and remains exposed and available for contact with the water during testing.

The CAHN system includes a movable stage which can be translated at a steady rate up and down. The test sample is hung from or otherwise mounted onto the selected loop of the balance, and a beaker of water is placed on the moveable stage. The stage is brought up so that the lower edge of the sample is just above the water surface, and the test is begun. Software, which is provided with the CAHN system, controls the experiment in accordance with parameters which are input by the user. For the fiber testing, the test sample is installed on the balance, and the balance is tared to provide a measure of water uptake as the sample is in contact with the water. The software is instructed to collect force readings at one second intervals. A 2 mm length of the exposed portion of the test sample is immersed into the water, and the stage is stopped. The test sample is left in the water for 1 minute as the software collects force readings at the one second intervals. The test sample is then pulled back out of the water.

Figure 14:
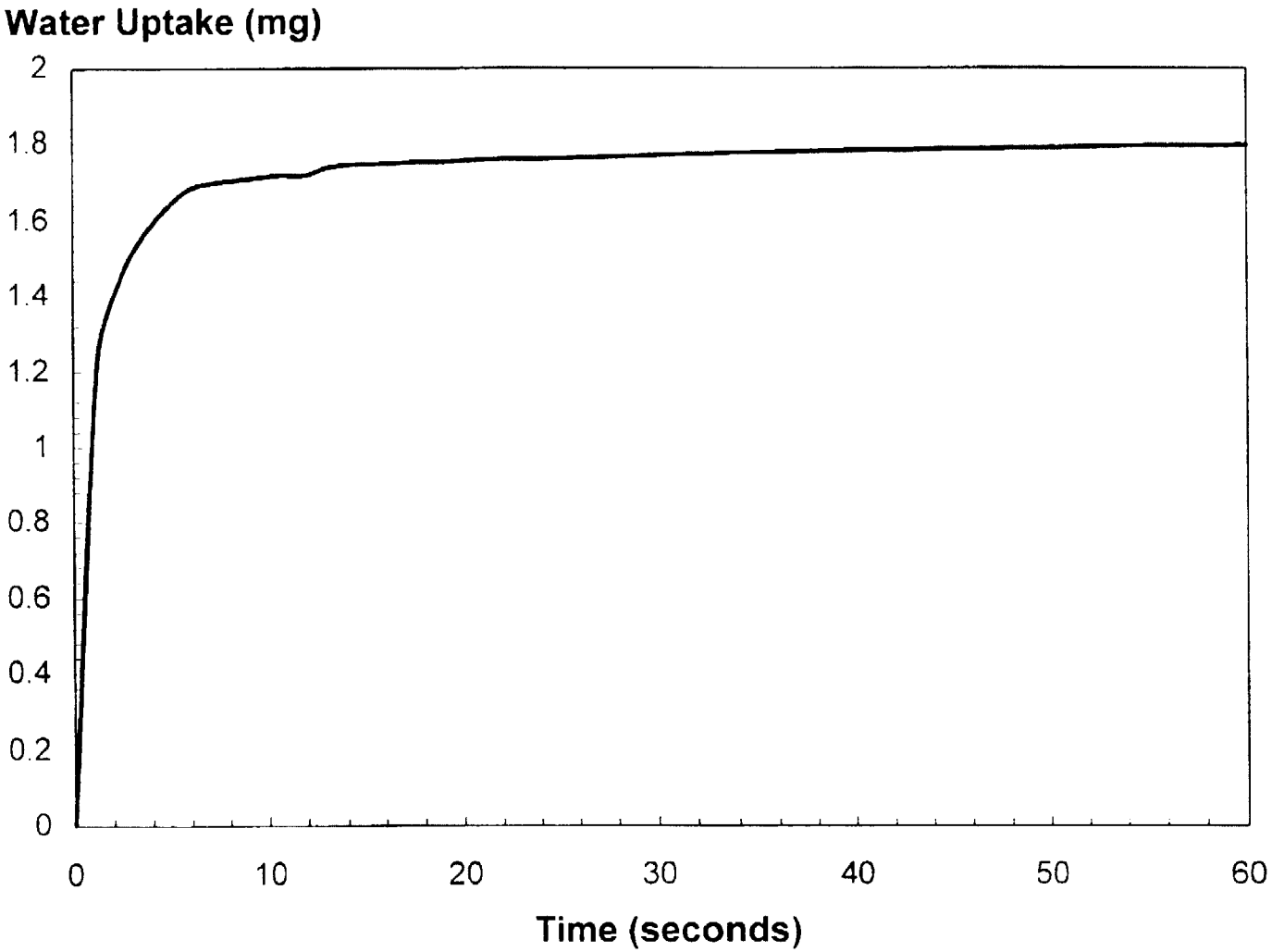
FIG. 14 shows a representative, graphical plot of the gained weight of water versus time for a porous fiber sample.

The data collected from an experiment is then evaluated. In particular, the data can be exported into suitable spreadsheet software, such as *Microsoft Excel version* 5.0, and processed to generate a plot of weight versus time for the 1 minute soak in the water. The plot shows the trend of water uptake for the test sample, and provides a convenient basis for comparing the relative water uptake performance and the relative levels of water accessibility of different fiber samples. To allow a better comparison between samples of different size fiber, the plotted data of the weight gain as function of time for the different samples were normalized based on a fiber having a weight of 0.0416 mg. The normalization factor was the ratio of the dry weight of the tested fiber to 0.0416 mg. The water uptake rate is determined at the two-second time mark of the curve generated by plotting the normalized weight increase versus the amount of elapsed time during the one minute soaking period. The water uptake rate shown in the examples was determined by calculating the slope of the plotted curve at the data point recorded in the first second of the data measurement, as representatively shown in FIG. 14. The water uptake amount listed in the examples was the total weight gain recorded at the 1 minute (60 sec) time of measurement in the data plot. It should be noted that the measured and recorded weight gain may include a weight gain due to the water absorbed into the initial porous structure, as well as weight gains due to other interactions between the fiber and water. For example, a coating layer of water can form on the fiber. In addition, the fiber structure can swell to provide pores with increased void volume, or the fiber can otherwise change in configuration to provide an increased capacity for acquiring and holding absorbed water.

Scanning Electron Microscopy and Image Analysis

Electron photomicrographs can be generated by conventional techniques which are well known in the imaging art. In addition, the samples can be prepared for the desired imaging by employing well known, conventional preparation techniques.

Since the porous fiber of the invention can be very ductile even at low temperatures, it is important to avoid an excessive smearing of the fiber material when the fiber sample is being cut and prepared for an imaging of the fiber cross-section. In a suitable preparation technique, the samples can, for example, be submerged in ethanol for 1 hour and then plunged into liquid nitrogen. For the fiber cross-sections, the surfaces can be prepared by cryomicrotomy, such as by using a Reichert Ultracut S microtome with FCS cryo-sectioning system (Leica, Deerfield, Ill.), in which a fresh 6 mm glass knife at temperatures of −180° C. is used. The resulting fiber can then be mounted on an appropriate stub and coated with gold or Au/Pd (gold/palladium). The fiber microstructure can be imaged by scanning electron microscopy, such as by using a JSM 6400 (JEOL, Peabody, Mass.) scanning electron microscope with both secondary and backscatter electron detectors.

Automated image analyses of voids and fiber pores can be conducted by well known, conventional techniques. Examples of such techniques are described in "APPLICATION OF AUTOMATED ELECRON MICROSCOPY TO INDIVIDUAL PARTICLE ANALYSIS" by Mark S. Germani, *AMERICAN LABORATORY*, published by International Scientific Communications, Inc.; and in "INTRODUCTION TO AUTOMATED PARTICLE ANALYSIS" by T. B. Vander Wood (copyright 1994, MVA, Inc., 550 Oakbrook Parkway #200, Norcross, Ga. 30093), *Proc. 52nd Annual Meeting of the Microscopy Society of America*, G. W. Bailey and A. J. Garratt-Reed, Eds., published by San Francisco Press.

The image analyses to provide pore distribution data for Example 1 was conducted by Materials Analytical Services, a laboratory having offices located at Norcross, Ga. The image analyses to provide pore distribution data for Example 4 was conducted by MVA, Inc., a laboratory having offices located at Norcross, Ga.

The various image analyses can, for example, be done with a Noran Voyager image analysis system employing a magnification of 5,000×. The data are generated by taking average of a total of twelve fields. The system is available from NORAN Instrument, Inc., a business having offices in Middleton, Wis., and systems capable of providing substantially equivalent performance may also be employed. During the course of the image analyses, the image of the porous structure can be digitized employing conventional techniques. An example of a digitized image is representatively shown in FIG. 13.

Optical Microscopy

To examine the microstructure along the outside surface of the porous fiber, optical microscopy can be a suitable technique. In particular, conventional oil-immersion optical microscopy can be employed. With this technique, the samples are prepared by placing in an immersion oil having a refractive index (Nd) of 1.516 at 23° C. on a glass slide, and are coverslipped. The immersion oil can be an oil available from OLYMPUS OPTICAL CO. LTD., a business having offices in Lake Success, N.Y. The samples are photographed using an oil immersion 100×objective, a high-speed film, such as Kodak Gold 400 ASA, 35 mm film, and using daylight temperature illumination. A suitable microscope is a OLYMPUS BH-2 optical microscope, which is available from OLYMPUS OPTICAL CO. LTD., , a business having offices in Lake Success, N.Y. Other optical microscopes and equipment having substantially equivalent capabilities may also be employed.

EXAMPLE 1

The following Examples are to provide a more detailed understanding of the invention. The examples are representative and are not intended to specifically limit the scope of the invention.

A resin composed of polypropylene (Himont PF301) ( 90 wt %) and $TiO_2$ filler particles (SCC 4837 by Standridge Color Corporation) (10 wt %) was intermixed with Dow Corning D193 surfactant (6 wt %, based on the total weight of the filler and the resin) by extruding twice through laboratory Haake twin screw extruder. The $TiO_2$ particle size was in the range of about 0.1 to 0.5 microns (μm), as measured by a scanning electron microscopy (SEM). The concentrations of the fillers were measured by ashes analysis. The surfactant Dow Coming D193 had a HLB number of 12.2. The fiber spinning process included feeding the combined materials into a hopper and extruding the materials through a single-screw extruder having a length-to-diameter ratio of 24 (L/D=24/1). The extruder had three heating zones, a metering pump, an on-line static mixer, and a spinpack with 4 holes, each hole having a diameter of 0.3 mm. During the spinning extrusion of the fiber, the fiber was subjected to a draw-down ratio of 40. During the quenching of the fiber, the nascent fiber was pre-wetted with a first surface-active liquid delivered through a metering coating die. The first surface-active liquid was a solution composed of isopropanol and water mixed in a ratio of 9-parts isopropanol to 1-part water, by volume. The fiber was then stretched in air by 2× (a draw ratio of 2), followed by stretching by 1.7× (a draw ratio of 1.7) in a bath provided by a second surface-active liquid. The second surface-active liquid was a solution composed of isopropanol and water mixed in a volume ratio of 9-parts isopropanol to 1-part water. The fiber was then heat-set at 80° C. before accumulation onto a winder. The mechanical properties of the resultant porous fiber were then measured by a Sintech tensile tester, and are summarized in the following TABLES 1 and 2. The number of pores per $\mu m^2$ of cross-section of the fiber was about 0.74 and the number of pores per $\mu m^2$ of external surface was about 0.08.

EXAMPLE 2

A resin composed of polypropylene 95.3% (Himont PF301); 1.4% $TiO_2$ concentrate, inorganic filler (SCC 4837 by Standridge Color Corporation) and 3.3 wt.% of powdered polydimethyl silsesquioxane, organic filler (Dow Corning #23 Additive); was intermixed with 6 wt.% (based on the total weight of the resin and the filler) of a silicone glycol surfactant (Dow Corning D193) by extruding twice through laboratory Haake twin-screw extruder. The particle size of the organic filler ranged from 1 to 5 microns as measured by SEM. The combined material was then extruded through a single-screw extruder (L/D=24/1), which included three heating zones, an on-line static mixer, a metering pump, and a spinpack with 4 holes, each hole having a diameter of 0.3 mm. During the spinning extrusion of the fiber, the fiber was subjected to a draw-down ratio of 33.

During the quenching of the fiber, the nascent fiber was pre-wetted with a first surface-active liquid delivered through a metering coating die. The first surface-active liquid was a solution composed of 2 wt.% of a surfactant (IGEPAL RC-630) in a isopropanol/water solvent. The solvent was composed of isopropanol and water mixed in a volume ratio of 9-parts isopropanol to 1-part water. The fiber was then stretched in air by 1.17×, and subsequently stretched by 2× in bath provided by a second surface-active liquid. The second surface-active liquid was a solution composed of isopropanol and water mixed in a ratio of 9-parts isopropanol to 1-part water, by volume. The fiber was then heat-set at 85° C. in an on-line oven before accumulation onto a winder. The mechanical properties of the porous fiber were then measured by a Sintech tensile tester, and are summarized in the following TABLE 1.

EXAMPLE 3

A resin composed of 93.2 wt.% polypropylene (Himont PF301); 1.4 wt.% $TiO_2$ concentrate (SCC 4837 by Standridge Color Corporation) and 5.4 wt.% CaCO3 (Omyacarb UF from Omya Inc.), which was surface-modified with 6 wt % (based on the weight of the filler) of silicone glycol D193 surfactant, was intermixed by extruding twice through a laboratory Haake twin-screw extruder. The particle sizes of the CaCO3 filler were within the range of 1 to 3 microns, as measured by SEM. The combined material was then extruded through a single-screw extruder (L/D=24/1), which include an on-line static mixer, a metering pump, and a spinpack with 8 holes, each hole having a diameter of 0.3 mm. During the spinning extrusion, the fiber was subjected to a draw-down ratio of 33. During the quenching of the fiber, the nascent fiber was pre-wetted with a first surface-active liquid delivered through a metering coating die. The first surface-active liquid was a solution composed of isopropanol and water mixed in a volume ratio of 9-parts isopropanol to 1-part water. The fiber was then stretched in air by 1.17×, and subsequently stretched 2× stretching in a bath provided by a second quantity of surface-active liquid. The second surface-active liquid was a solution composed of 1 wt % IGEPAL RC-630 in a isopropanol/water solvent. The solvent was composed of isopropanol and water mixed in a volume ratio of 9-parts isopropanol to 1-part water. The fiber was then heat-set at 80° C. before accumulation onto a winder. The mechanical properties of the porous fiber were then measured by a Sintech tensile tester, and are summarized in the following TABLE 1.

EXAMPLE 4

A resin composed of 88.8 wt % polypropylene (Himont PF301), 1.3 wt % $TiO_2$ concentrate (SCC 4837 by Standridge Color Corporation), and 9.9 wt % CaCO3 (Omyacarb UF from Omya, Inc.) which was surface-modified by 6 wt % (based on the weight of the filler) of silicone glycol D193 surfactant, was intermixed by extruding twice through a laboratory Haake twin-screw extruder. The particle sizes of the CaCO3 were within the range of 1 to 3 microns as measured by SEM. The combined material was then extruded through a single-screw extruder (L/D=24/1), which included three heating zones, an on-line static mixer, a metering pump, and a spinpack with 15 holes, each hole having a diameter of 0.5 mm. During the extrusion-spinning operation, the fiber was subjected to a draw-down ratio of 40. During quenching, the nascent fiber was pre-wetted with a first surface-active liquid delivered through a metering coating die. The first surface-active liquid was composed of a mixture of isopropanol and water provided at a volume ratio of 9.8-parts of isopropanol to 0.2-parts water. The fiber was then stretched in air by 1.5×, and subsequently stretched by 1.4× in a bath provided by a second quantity of surface-active liquid. The second surface-active liquid was composed of isopropanol and water mixed in a volume ratio of 9-parts isopropanol to 1-part water. The fiber was then heat-set at 90° C. with an on-line oven, followed by collecting through a web forming box. The mechanical properties of the porous fiber were then measured by a Sintech tensile tester, and are summarized in the following TABLES 1 and 2. The number of pores per $\mu m^2$ of cross-section of the fiber was about 0.19.

EXAMPLE 5

A resin composed of polypropylene (Himont PF301) ( 90 wt %) and $TiO_2$ filler particles (SCC 4837 by Standridge Color Corporation) (10 wt %) was intermixed with Dow Corning D193 surfactant (6 wt %, based on the total weight of the filler and the resin) by extruding twice through laboratory Haake twin screw extruder. The $TiO_2$ particle size was in the range of 0.1 to 0.5 microns, as measured by a scanning electron microscopy (SEM). The concentrations of the fillers were measured by ashes analysis. The surfactant Dow Corning D193 had a HLB number of 12.2. The fiber spinning process included feeding the combined materials into a hopper and extruding the materials through a single-screw extruder having a length-to-diameter ratio of 24 (L/D=24/1). The extruder had three heating zones, a metering pump, an on-line static mixer, and a spinpack with 4 holes, each hole having a diameter of 0.3 mm. During the spinning extrusion of the fiber, the fiber was subjected to a draw-down ratio of 11. During the quenching of the fiber, the nascent fiber was pre-wetted with a first surface-active liquid delivered through a metering coating die. The first surface-active liquid was a solution composed of isopropanol and water mixed in a ratio of 9-parts isopropanol to 1-part water, by volume. The fiber was then stretched in air by 1.58× followed by stretching by 2.2× in a bath provided by a second surface-active liquid. The second surface-active liquid was a solution composed of isopropanol and water mixed in a volume ratio of 9-parts isopropanol to 1-part water. The fiber was then heat-set at 80° C. before accumulation onto a winder. The mechanical properties of the resultant porous fiber were then measured by a Sintech tensile tester, and are summarized in the following TABLE 1.

EXAMPLE 6

A resin composed of polypropylene (Himont PF301) ( 90 wt %) and $TiO_2$ filler particles (SCC 4837 by Standridge Color Corporation) (10 wt %) was intermixed with Dow Corning D193 surfactant (6 wt %, based on the total weight of the filler and the resin) by extruding twice through laboratory Haake twin screw extruder. The $TiO_2$ particle size was in the range of 0.1 to 0.5 microns, as measured by a scanning electron microscopy (SEM). The concentrations of the fillers were measured by ashes analysis. The surfactant Dow Corning D193 had a HLB number of 12.2. The fiber spinning process included feeding the combined materials into a hopper and extruding the materials through a single-screw extruder having a length-to-diameter ratio of 24 (L/D=24/1). The extruder had three heating zones, a metering pump, an on-line static mixer, and a spinpack with 4 holes, each hole having a diameter of 0.3 mm. During the spinning extrusion of the fiber, the fiber was subjected to a draw-down ratio of 11. During the quenching of the fiber, the nascent fiber was pre-wetted with a first surface-active liquid delivered through a metering coating die. The first surface-active liquid was a solution composed of isopropanol and water mixed in a ratio of 9-parts isopropanol to 1-part water, by volume. The fiber was then stretched in air by 1.17× followed by stretching by 1.5× in a bath provided by a second surface-active liquid. The second surface-active liquid was a solution composed of isopropanol and water mixed in a volume ratio of 9-parts isopropanol to 1-part water. The fiber was then heat-set at 80° C. before accumulation onto a winder. The mechanical properties of the resultant porous fiber were then measured by a Sintech tensile tester, and are summarized in the following TABLE 1.

EXAMPLE 7

A resin composed of polypropylene (Himont PF301) ( 90 wt %) and $TiO_2$ filler particles (SCC 4837 by Standridge Color Corporation) (10 wt %) was intermixed with Dow Corning D193 surfactant (6 wt %, based on the total weight of the filler and the resin) by extruding twice through laboratory Haake twin screw extruder. The $TiO_2$ particle size was in the range of 0.1 to 0.5 microns, as measured by a scanning electron microscopy (SEM). The concentrations of the fillers were measured by ashes analysis. The surfactant Dow Corning D193 had a HLB number of 12.2. The fiber spinning process included feeding 10 the combined materials into a hopper and extruding the materials through a single-screw extruder having a length-to-diameter ratio of 24 (L/D=24/1). The extruder had three heating zones, a metering pump, an on-line static mixer, and a spinpack with 4 holes, each hole having a diameter of 0.3 mm. During the spinning extrusion of the fiber, the fiber was subjected to a draw-down ratio of 33. During the quenching of the fiber, the nascent fiber was pre-wetted with a first surface-active liquid delivered through a metering coating die. The first surface-active liquid was a solution composed of isopropanol and water mixed in a ratio of 9-parts isopropanol to 1-part water, by volume. The fiber was then stretched in air by 1.17× followed by stretching by 1.5× in a bath provided by a second surface-active liquid. The second surface-active liquid was a solution composed of isopropanol and water mixed in a volume ratio of 9-parts isopropanol to 1-part water. The fiber was then heat-set at 80° C. before accumulation onto a winder. The mechanical properties of the resultant porous fiber were then measured by a Sintech tensile tester, and are summarized in the following TABLE 1.

EXAMPLE 8

A resin composed of polypropylene (Himont PF301) ( 90 wt %) and $TiO_2$ filler particles (SCC 4837 by Standridge Color Corporation) (10 wt %) was intermixed with Dow Corning D193 surfactant (6 wt %, based on the total weight of the filler and the resin) by extruding twice through laboratory Haake twin screw extruder. The $TiO_2$ particle size was in the range of 0.1 to 0.5 microns, as measured by a scanning electron microscopy (SEM). The concentrations of the fillers were measured by ashes analysis. The surfactant Dow Corning D193 had a HLB number of 12.2. The fiber spinning process included feeding the combined materials into a hopper and extruding the materials through a single-screw extruder having a length-to-diameter ratio of 24 (L/D 24/1). The extruder had three heating zones, a metering pump, an on-line static mixer, and a spinpack with 4 holes, each hole having a diameter of 0.3 mm. During the spinning extrusion of the fiber, the fiber was allowed to free-fall. During the quenching of the fiber, the nascent fiber was pre-wetted with a surface-active liquid delivered through a metering coating die. The surface-active liquid was a solution composed of isopropanol and water mixed in a ratio of 9-parts isopropanol to 1-part water, by volume. The mechanical properties of the resultant porous fiber were then measured by a Sintech tensile tester, and are summarized in the following TABLE 1.

EXAMPLE 9

This sample was composed of a commercially available polypropylene staple fiber which was obtained from American Barmag, a business having offices located in Charlotte, N.C. The staple fiber had a fiber length of 38 mm, and was surfactant-modified by immersing in a solution of 10 wt % hydrophilic silicon glycol (Dow Corning 193) surfactant in acetone for 1 hour and drying at 50° C. for 6 hours before testing. The properties of the fiber were measured and are summarized in the following TABLE 1.

EXAMPLE 10

This sample was composed of a commercially available polypropylene staple fiber having a fiber length of 38 mm, and was obtained from American Barmag, a business having offices located in Charlotte, N.C. The properties of the fiber were measured and are summarized in the following TABLE 1.

EXAMPLE 11

This sample is a conventional porous fiber obtained from Asahi Medical Co. Ltd., a business having offices located in Tokyo, Japan. As representatively shown in FIGS. 3, 4, and 10, the fiber had a lumen which extended longitudinally along the fiber length through the fiber interior. It is believed that the porous structure in the illustrated fiber was created by a solution spinning technique where the lumen configuration allowed an introduction of the coagulation liquid to contact the nascent fiber along both an inside and outside surface of the fiber material. The structure has large finger-like pores within the inner wall of the fiber and has a sponge-like configuration of lacy pores in the vicinity of the outer wall. In addition, the fiber typically has a thin, skin layer at its outer surface, which may prevent the penetration water into the fiber. The properties of the fiber were measured and are summarized in the following TABLE 1.

EXAMPLE 12

Figure 6:
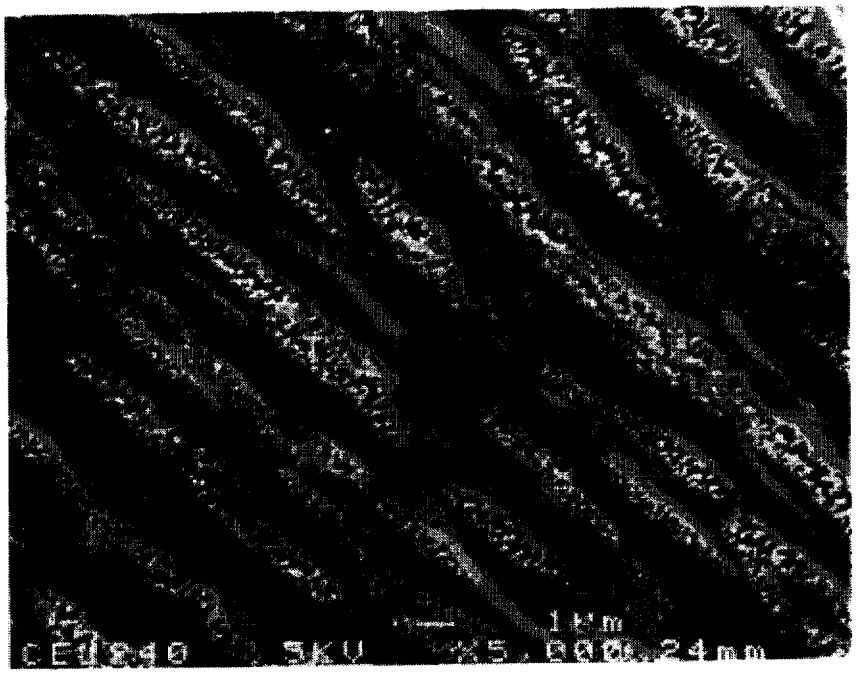
FIG. 6 is a scanning electron photomicrograph, taken at a magnification of 5,000×, showing an enlarged view of a portion of the cross-section shown in FIG. 5.
Figure 7:
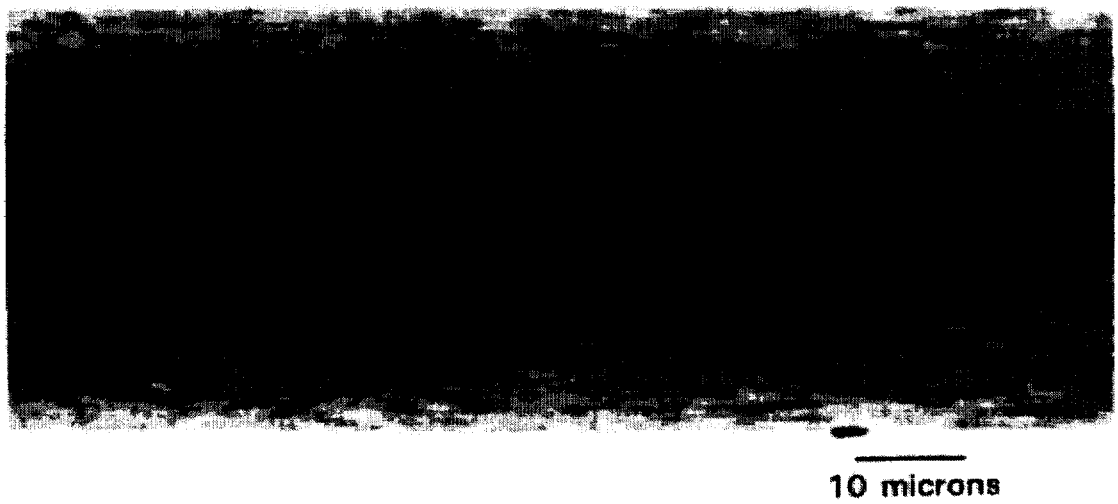
FIG. 7 is an optical photomicrograph, based on oil-immersion optical microscopy taken at a magnification of 1,500×, showing a representative view of the voids on the surface and in the bulk of a porous fiber of the invention.
Figure 8:
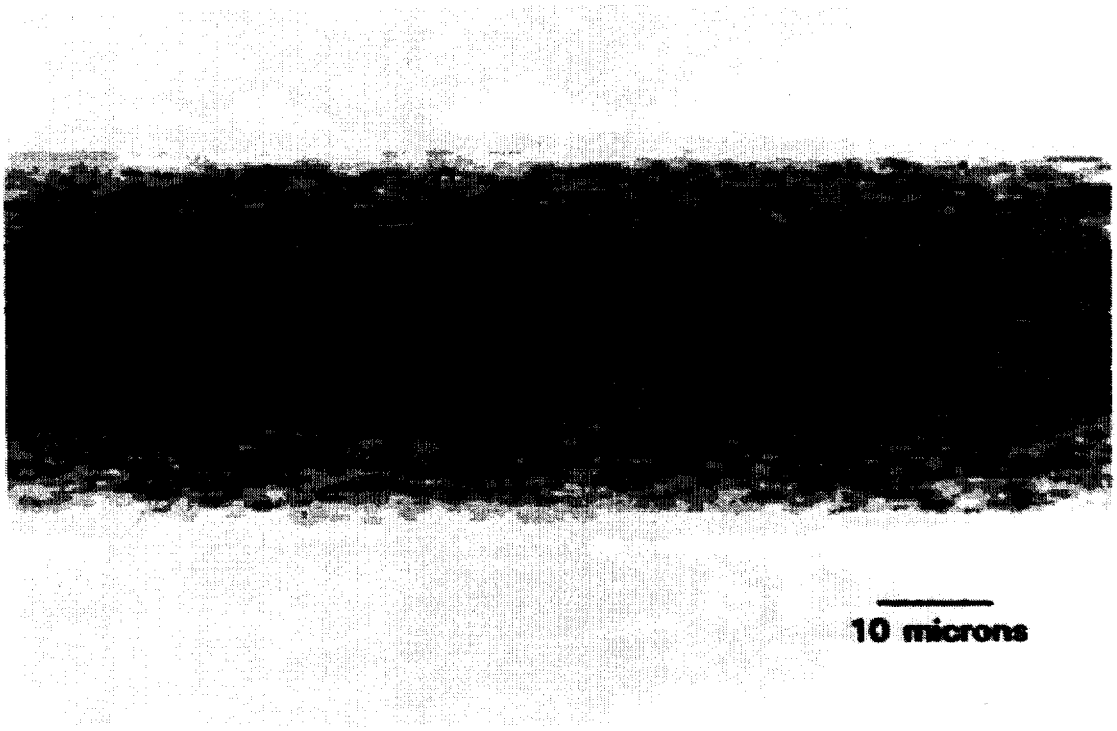
FIG. 8 is an optical photomicrograph, based on oil-immersion optical microscopy taken at a magnification of 1,500×, showing another view of the voids along the surface and in the bulk of a porous fiber of the invention.
Figure 9:
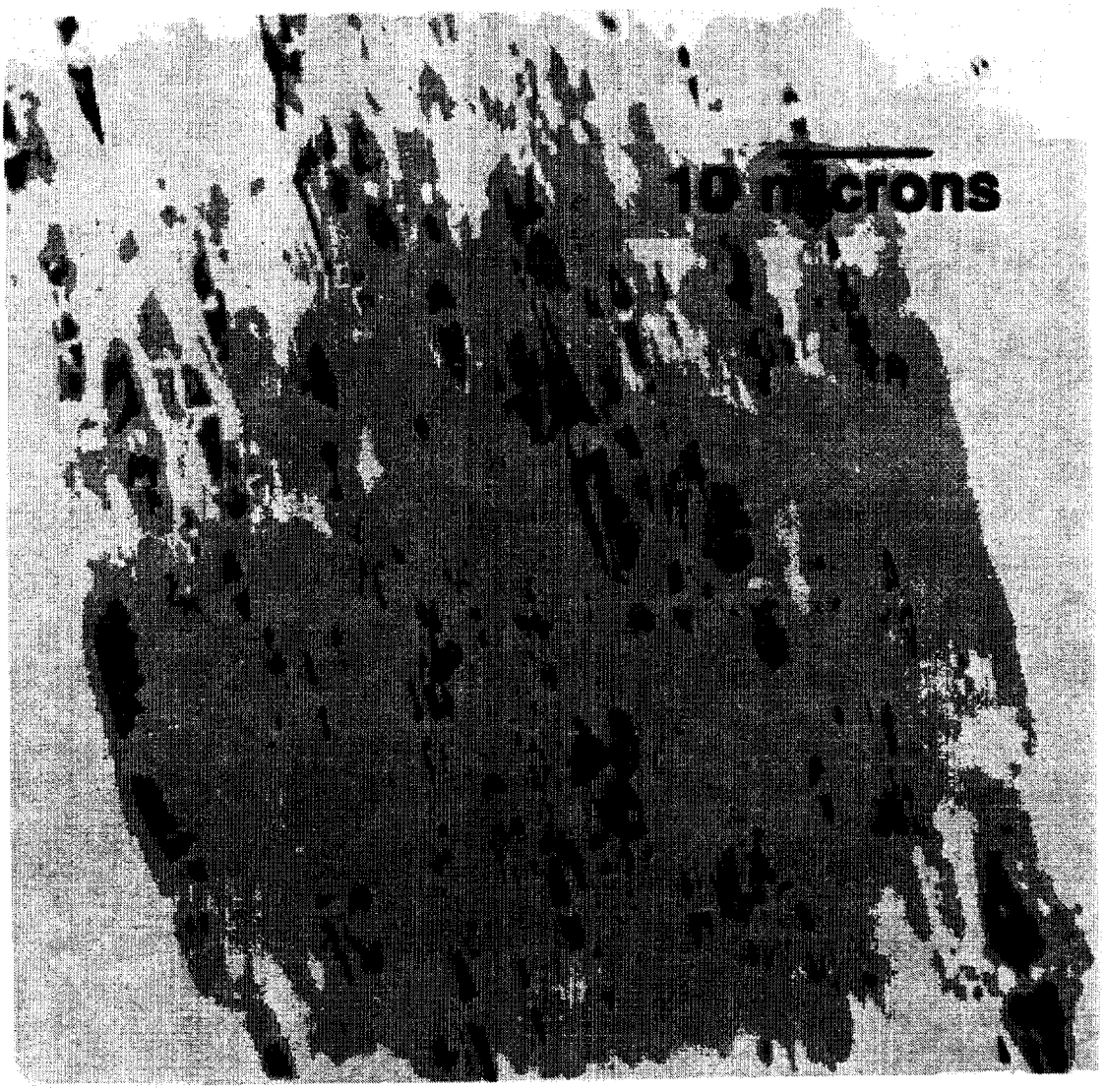
FIG. 9 shows a representative view of the voids along the outer surface of another porous fiber of the invention, taken at a magnification of 3,000×.
Figure 9A:
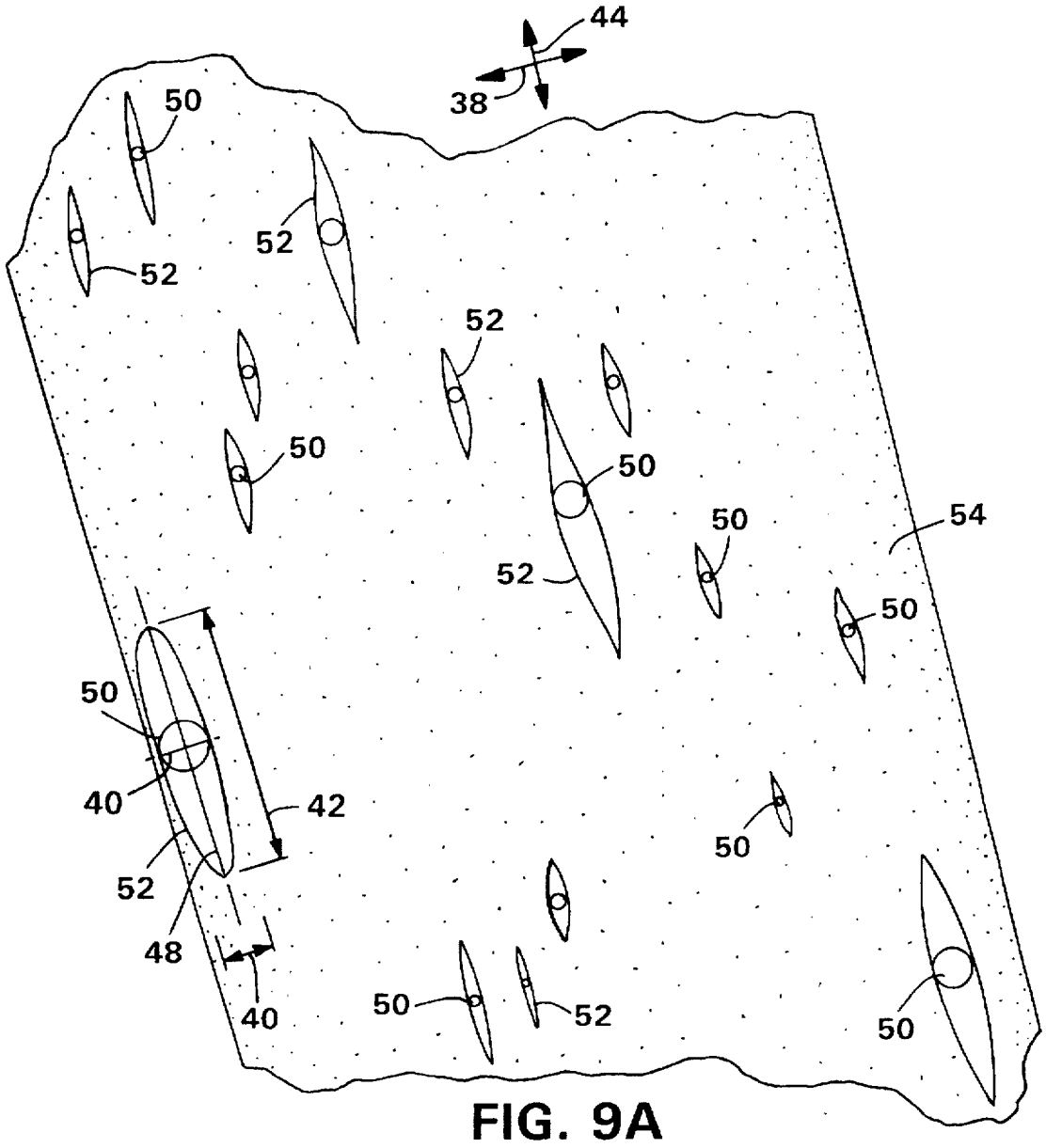
FIG. 9A representatively shows a schematic view of particular pores shown in FIG. 9.

This sample is another conventional porous fiber distributed under the tradename CELGARD by Hoechst Celanese, a business having offices in Charlotte, N.C. As representatively shown in FIGS. 5, 6, and 11, the fiber had a longitudinal lumen, and it is believed that the porous structure of the fiber was created by a process which employed a plurality of incremental stretching steps. The structure, as shown in the cross-sectional view, includes a lamellar-like structure produced by creating inter-lamellar volume in a pre-crystalline structure. In this structure, the pore contains microfibrils that oriented in the length-wise direction of the fibers and joint portions which are composed of stacked lamella. The properties of the fiber were measured and are summarized in the following TABLE 1.

EXAMPLE 13

This sample is a microporous polypropylene fiber which is shown in example 1 of U.S. Pat. No. 4,550,123 owned by Albany International, a business having offices located in Mansfield, Mass. According to the description of example 1 in the patent, the fiber had a denier of 8.8 d. Other properties of the fiber are listed in the following TABLE 1.

TABLE 1

| Example No. | Water-uptake rate (mg/sec) | Water-uptake (mg per 1 min.) | Break stress (MPa) | Elongation at break (%) | Fiber size | Toughness index (g-cm per denier-cm) |
|---|---|---|---|---|---|---|
| 1 | 0.79 | 1.2 | 427 | 157 | 4.7 d | 4.2 |
| 2 | 0.58 | 1.1 | 391 | 111 | 5.7 d | 2.7 |
| 3 | 0.84 | 1.5 | 310 | 95 | 5.8 d | 1.8 |
| 4 | 0.89 | 1.3 | 358 | 150 | 1.8 d | 3.3 |
| 5 | 1.01 | 1.8 | 295 | 119 | 16 d | 2.2 |
| 6 | 0.67 | 1.4 | 231 | 168 | 18 d | 2.4 |
| 7 | 0.21 | 0.3 | 251 | 183 | 5.6 d | 2.9 |
| 8 | 0.014 | 0.015 | 47 | 966 | 68 d | 2.8 |
| 9 | 0.02 | 0.25 | 220 | 55 | 2.8 d | 0.75 |
| 10 | 0.002 | 0.005 | 362 | 60 | 2.8 d | 1.30 |

TABLE 1-continued

| Example No. | Water-uptake rate (mg/sec) | Water-uptake (mg per 1 min.) | Break stress (MPa) | Elongation at break (%) | Fiber size | Toughness index (g-cm per denier-cm) |
|---|---|---|---|---|---|---|
| 11 | — | — | 8.4 | 10.1 | 300 microns | 0.003 |
| 12 | — | — | 51 | 207 | 300 microns | 0.65 |
| 13 | — | — | 217 | 23 | 8.8 d | 0.30 |

Having thus described the invention in rather full detail, it will be readily apparent that various changes and modifications can be made without departing from the spirit of the invention all of such changes and modifications are contemplated as being within the invention, as defined by the subjoined claims.

We claim:

1. A porous fiber which includes a fiber material having a plurality of elongate pores therein, and wherein said pores are formed in the fiber material which has been expanded and stretched away from filler material which is included in said fiber material, said fiber having:

a denier of about 50 or less;

a percent elongation at break of about 30% or more a tensile strength at break of about 200 MPa or more; and having said pores distributed over an outer surface of said fiber with an average distributional density of about 0.01 pores, or more, per $\mu m^2$ of said outer surface.

2. A fiber as recited in claim 1, wherein said fiber has a denier of about 20 or less.

3. A fiber as recited in claim 1, wherein said fiber has a denier of about 10 or more.

4. A fiber as recited in claim 1, wherein said fiber has a percent elongation at break of about 50% or more.

5. A fiber as recited in claim 1, wherein said fiber has a percent elongation at break of about 90% or more.

6. A fiber as recited in claim 1, wherein said pores include surface pores which are irregularly distributed over said outer surface of said fiber.

7. A fiber as recited in claim 1, wherein said pores include pores which are irregularly distributed through a cross-section of said fiber.

8. A fiber as recited in claim 1, wherein said fiber includes pores having generally ellipsoid shape.

9. A fiber as recited in claim 1, wherein said elongate pores have major axes thereof aligned substantially along a longitudinal dimension of said fiber.

10. A fiber as recited in claim 1, wherein said elongate pores have major axes thereof which measure about 0.1 μm or more in length.

11. A fiber as recited in claim 1, wherein said elongate pores have major axes thereof which measure about 30 μm or less in length.

12. A fiber as recited in claim 6, wherein said pores have an average distribution of about 10 pores, or less, per $\mu m^2$ of said outer surface.

13. A fiber as recited in claim 7, wherein said pores have an average distribution of about 0.01 pores, or more per $\mu m^2$ of said cross-section.

14. A fiber as recited in claim 7, wherein said pores have an average distribution of about 10 pores, or less, per $\mu m^2$ of said cross-section.

15. A fiber as recited in claim 1, wherein said porous fiber is substantially free of lumens.

16. A fiber as recited in claim 1, wherein said fiber includes a plurality of pores which are initiated at said particulate filler material.

17. A fiber as recited in claim 1, wherein said fiber includes a plurality of extended pores, each of which has an associated particulate initiator provided by said particulate filler material, and wherein each said extended pores has a length which is larger than a length of its associated particulate filler material.

* * * * *